US005083577A

United States Patent [19]

Cullen

[11] Patent Number: 5,083,577

[45] Date of Patent: Jan. 28, 1992

[54] APPARATUS FOR METERING TOBACCO

[75] Inventor: Edward T. Cullen, Louisville, Ky.

[73] Assignee: Brown & Williamson Tobacco Corporation, Louisville, Ky.

[21] Appl. No.: 588,900

[22] Filed: Sep. 27, 1990

[51] Int. Cl.[5] ..... A24B 7/14

[52] U.S. Cl. ..... 131/109.2; 131/84.3; 131/109.3; 131/110; 131/108

[58] Field of Search ..... 131/108, 109.1-109.2, 131/109.3, 110, 84.3

[56] References Cited

U.S. PATENT DOCUMENTS

| | | | |
|---|---|---|---|
| 1,808,794 | 6/1931 | Stelzer | 131/110 |
| 3,030,966 | 4/1962 | Lanore | 131/110 |
| 3,059,650 | 10/1962 | Gamberini | 131/84.3 |
| 3,088,468 | 5/1963 | Labbe | 131/110 |
| 3,095,883 | 7/1963 | Morris | 131/110 |
| 3,111,026 | 11/1963 | Powell | 131/110 |
| 4,207,907 | 6/1980 | Dyett | 131/110 |
| 4,417,594 | 11/1983 | Garrone | 131/110 |
| 4,564,027 | 1/1986 | Heitmann | 131/110 |
| 4,610,260 | 9/1986 | Heitmann | 131/110 |

*Primary Examiner*—V. Millin
*Assistant Examiner*—Lynne A. Reichard
*Attorney, Agent, or Firm*—Charles G. Lamb

[57] ABSTRACT

An apparatus for metering a measured amount of tobacco to, for example, a cigarette making machine to provide a uniform feed of tobacco to the cigarette making machine thereby reducing variations of the tobacco in the cigarettes made by the cigarette making machine. The apparatus includes a first conveyor for receiving a supply of tobacco, a second conveyor located downstream of the first conveyor for receiving tobacco from the first conveyor. A vacuum device is associated with the second conveyor for retaining a selected metered amount of tobacco on the second conveyor. An excess tobacco receiving device is located adjacent the second conveyor for receiving excess tobacco removed from the second conveyor. A metered tobacco removing device is also located adjacent the vacuum device downstream from the excess tobacco receiving device for removing the selected metered amount of tobacco from the second conveyor for use in, for example, a cigarette making machine. The apparatus further includes an excess tobacco return device for transferring the excess tobacco back to the first conveyor to be recycled back through the apparatus.

11 Claims, 2 Drawing Sheets

APPARATUS FOR METERING TOBACCO

BACKGROUND OF THE INVENTION (a) Field of the Invention

The present invention relates to tobacco feeding apparatus and more particularly to tobacco feeding apparatus which selectively meters the amount of tobacco being fed thereby.

(b) Description of the Prior Art

Various tobacco feeding apparatus are known to the art.

U.S. Pat. No. 1,808,794 teaches a tobacco spreader device including a moving sieve band subjected to a suction action and functioning to form a tobacco fleece, an impervious moving feed band located next to the delivery point of the sieve band such that the moving impervious feed band interrupts the suction action adjacent the delivery point of the sieve band and carries the tobacco fleece out of the range of the suction action exerted on the sieve band.

U.S. Pat. No. 3,030,966 teaches an apparatus for forming a continuous tobacco filler to a cigarette making machine. The apparatus includes an air-pervious conveyor with a device to feed the tobacco upwardly to the conveyor. A suction device is located above the conveyor to cause air flow upwardly through the conveyor whereby tobacco on the conveyor is held on the underside of the conveyor forming a tobacco filler. A trimmer having rotating trimmer discs which is located downstream of the air-flow zone trims the tobacco filler to a desired cross-sectional size by removing surplus tobacco from the conveyor. A hopper is located beneath the trimming device to receive the surplus tobacco.

U.S. Pat. No. 3,088,468 teaches an apparatus for use with a cigarette making machine for forming a tobacco filler which includes an air pervious conveyor to convey a stream of tobacco from which the filler is to be formed by the removal of excess tobacco. The conveyor has opposed side walls having tobacco engaging surfaces defining a tobacco confining channel, and a suction device to draw air into the channel and through the conveyor so as to flow through and compress the tobacco confined in the channels. A trimming device is located over the conveyor to separate and remove tobacco therefrom to form a filler of desired depth.

U.S. Pat. No. 3,095,883 teaches a continuous rod cigarette making machine in which a continuous tobacco filler is formed on an air-pervious conveyor, and is held to the conveyor by suction.

U.S. Pat. No. 3,111,026 teaches a continuous rod cigarette making machine in which a continuous tobacco filler is formed including an endless air pervious conveyor with a suction chamber in communication with the top run of the conveyor to draw air through the top run to hold the tobacco filler to the conveyor.

U.S. Pat. No. 4,207,907 teaches a cigarette making machine which includes an air-pervious band which carries a cigarette tobacco filler by means of suction to a cigarette wrapper web.

U.S. Pat. No. 4,564,027 teaches an apparatus for building a continuous tobacco stream at one side of an air permeable conveyor, the other side of which is adjacent to a suction chamber. Two side walls which define with one side of the conveyor a tobacco channel receiving tobacco particles merge and is provided with inclined passages for the flow of compressed air in directions having components in the direction of travel of the tobacco stream. This ensures that all of the tobacco particles are accelerated in the direction of travel of the stream before they enter the channel on their way toward the one side of the air permeable conveyor.

U.S. Pat. No. 4,610,260 teaches a distributor of a cigarette making machine having an air permeable tobacco transporting conveyor adjacent to a channel which is bounded by two sidewalls and receives a mixture of tobacco particles and compressed air. The quantity of air entering the channel exceeds the quantity which can be evacuated through the air permeable conveyor. Therefore, at least one of the sidewalls has a recessed air-permeable portion adjacent the external suction chamber to draw surplus air from the channel without adversely influencing the trajectories of tobacco particles which are propelled toward the conveyor to form thereon a growing homogenous tobacco stream.

SUMMARY OF THE INVENTION

The present invention provides an apparatus for metering the flow of tobacco to a downstream operation such as a cigarette making machine providing for the recirculation of excess tobacco back to the metering apparatus so that no tobacco is wasted.

The present invention also provides an apparatus for metering the flow of tobacco which includes a vacuum device for selectively separating excess tobacco from a selected metered amount of tobacco.

More particularly, the present invention provides an apparatus for metering tobacco fed to a downstream operation comprising first conveyor means for receiving a supply of tobacco; second conveyor means located downstream of the first conveyor means; vacuum means associated with the second conveyor means for retaining a metered amount of tobacco on the second conveyor means and removing an excess amount of tobacco from the second conveyor means; excess tobacco receiving means located adjacent the second conveyor means for receiving the excess tobacco removed from the second conveyor; and, means for returning the removed excess tobacco from the excess tobacco receiving means back to the first conveyor means.

DESCRIPTION OF THE DRAWING

A better understanding of the present invention will be had upon reference to the following detailed description in conjunction with the accompanying drawing wherein.

DETAILED DESCRIPTION OF THE PREFERRED EMBODIMENT

Figure 1:
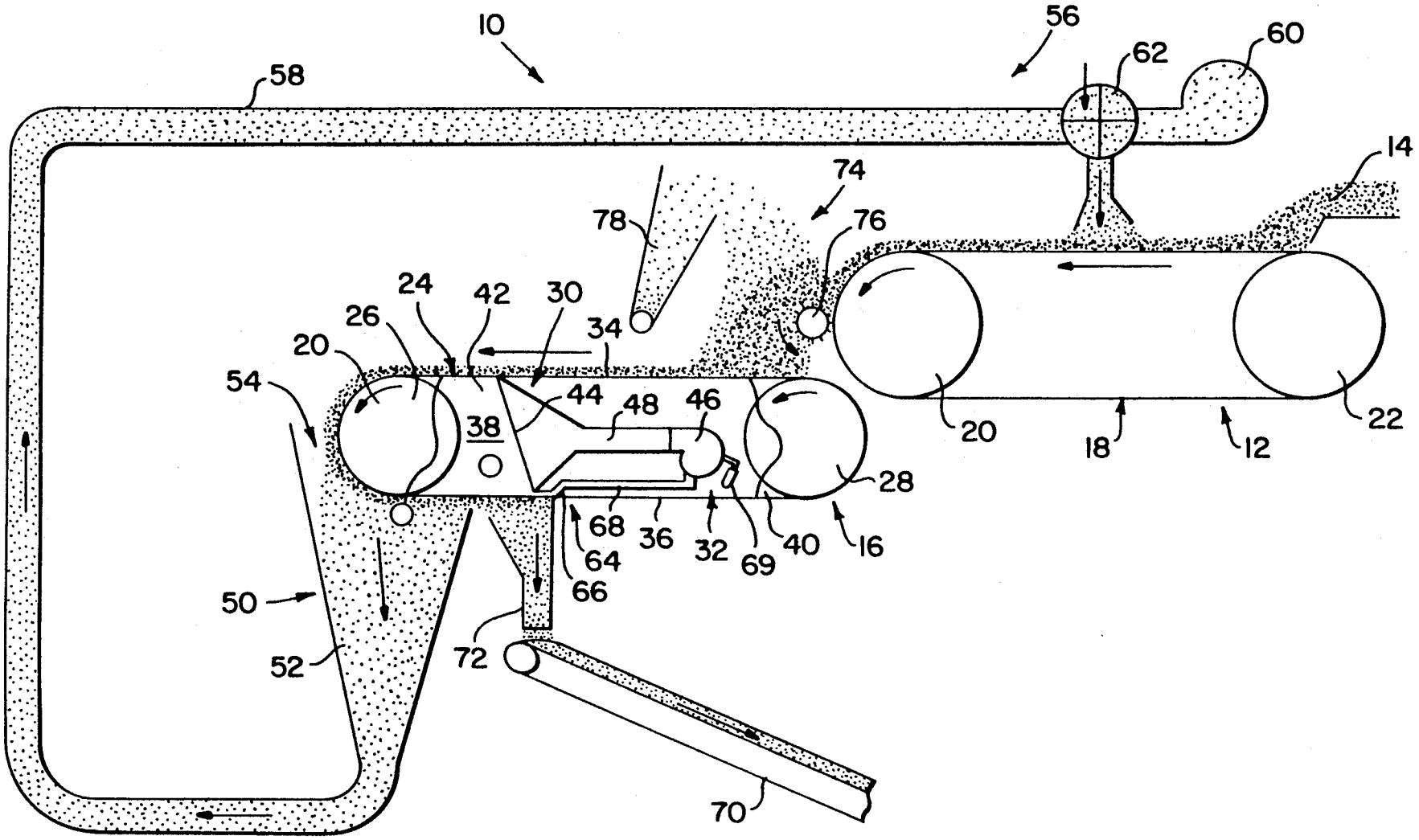
FIG. 1 is a schematic side view of the apparatus for metering tobacco, partially in cross-section to show internal details.

With reference to FIG. 1, there is shown an apparatus, generally denoted as the numeral 10, of the present invention for metering tobacco to be fed to a downstream location, or operation (not shown) such as, for example, a cigarette making machine or tobacco packaging operation whereat tobacco is supplied to fill tobacco pouches with measured amounts of tobacco.

The apparatus 10 includes a first conveyor means, generally denoted as the numeral 12, for receiving a supply of tobacco 14, and a second conveyor means 16 located downstream of the first conveyor means 14 for receiving the supply of tobacco 14 from the first conveyor means 12. As shown, the first conveyor means 12 is an endless conveyor belt apparatus having an endless conveyor belt 18 trained about a head pulley 20 and a tail pulley 22, and includes a variable speed drive motor (not shown). The second conveyor means 16 is also an endless conveyor belt apparatus having a perforated conveyor belt 24 trained about a head pulley 26 and a tail pulley 28 and also includes a variable speed motor (not shown). The head pulley 26 is perforated over its circumferential surface. The inlet or upstream end of the second conveyor means 16 is located below the outlet or downstream end of the first conveyor means 12, and preferably, the downstream end of the first conveyor means 12 overlaps the upstream end of the second conveyor means 16 by a short distance, for example, less than the radius of the tail pulley 26 of the second conveyor means 16.

Figure 2:
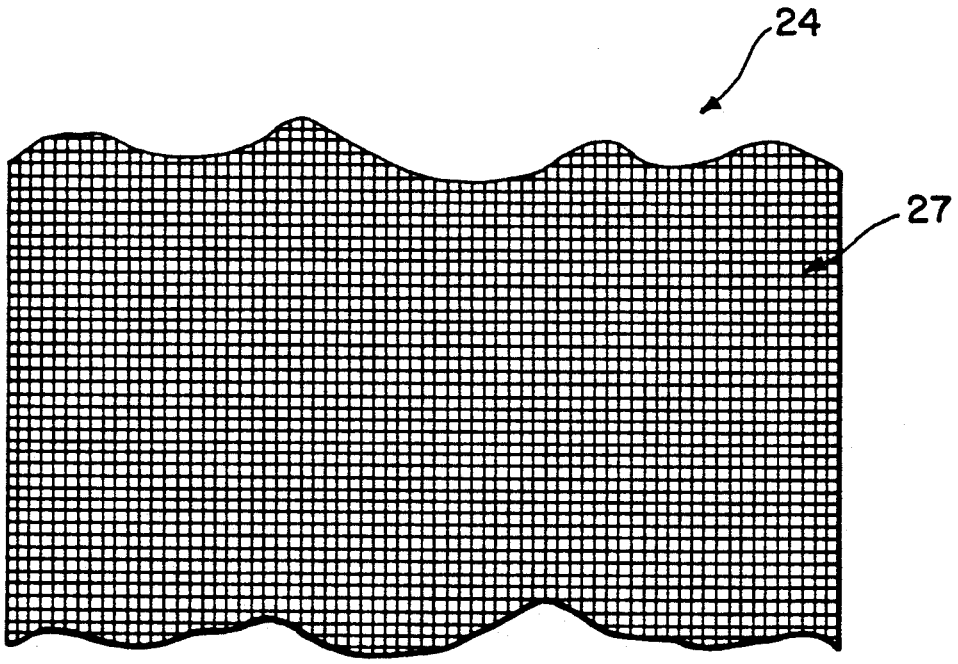
FIG. 2 is a plan view of a typical portion of a belt of one of the belt conveyors of the apparatus of FIG. 1; and, FIG. 3 is a plan view of a typical portion of another belt of one of the belt conveyors of the apparatus of FIG. 1.

With reference to FIG. 2, the conveyor belt 24 of the second conveyor means 16 can be constructed with perforations, generally denoted as the numeral 27, continuous over its entire length and width. Alternatively, as can be seen in FIG. 2, the conveyor belt 24 of the second conveyor means 16 can be constructed with spaced apart sections or areas 29 of perforations 27, with the remaining portions of the belt 24 being air impermeable.

The second conveyor means 16 further includes vacuum means, generally denoted as the numeral 30, associated with the second conveyor means 16 for retaining a selected metered amount of the tobacco on the second conveyor means 16 and allowing the removal of an excess amount of tobacco from the second conveyor means 16. The vacuum means 30 comprises a device 32 for creating a low pressure zone between the top conveyor belt flight 34 and the bottom conveyor belt flight 36 of the second conveyor 16 proximate the downstream end of the second conveyor 16. The low pressure creating device 32 includes a plenum chamber 38 formed between the top conveyor belt flight 34 and the bottom conveyor flight 36, the downstream end of the second conveyor 16, the side walls 40 and 42 of the second conveyor 16, and perforated partition 44 spaced between the upstream end and downstream end of the second conveyor 16. The perforated partition 44 extends vertically the distance between the conveyor belt top flight 34 and conveyor belt bottom flight 36 and extends horizontally the distance between the side walls 40 and 42 of the second conveyor 16. The plenum chamber 38 is in air flow communication with a variable speed vacuum pump or fan 46 by means of an air flow conduit 48 which extends from the exterior side of the perforated partition 44 to the vacuum pump 46. The vacuum pump 46 creates a low pressure zone or area in the plenum of a selected amount to hold a preselected, metered amount of tobacco on the top flight 34 of the endless perforated conveyor belt 24 proximate the downstream end of the second conveyor 16, as the belt 24 moves over the perforated head pulley 26 making the transition between the top conveyor flight 34 and the bottom conveyor flight 36.

Excess tobacco receiving means 50 is located adjacent the second conveyor means 16 for receiving the excess tobacco being removed from the second conveyor 16. The excess tobacco receiving means 50 comprises a hopper 52 located below the second conveyor 16 proximate the downstream end of the second conveyor 16 such that a portion of the open top end 54 of the hopper 52 overlaps a portion of the bottom conveyor flight 36 adjacent the downstream end of the second conveyor 16. Moreover, a portion of the open top end 54 of the hopper 52 extends outwardly past the downstream end of the second conveyor 16.

The apparatus 10 further includes means, generally denoted as the numeral 56, for returning the removed excess tobacco from the excess tobacco receiving means 50 back to the first conveyor 12. The excess tobacco return means 56 includes a conduit 58 having its inlet end open to the bottom of the hopper 52 and having its outlet end over the top flight of the first conveyor means 12. The conduit 58 is also in air flow communication with a blower or fan 60 which is used to establish an air flow in the conduit 58 from the conduit inlet end to the conduit outlet end. The air flow in the conduit 58 conveys excess tobacco from the hopper 52 and through the conduit 58 back to the first conveyor means 12. An air lock valve 62 is positioned in the conduit 58 upstream of the conduit outlet end to provide for selectively shutting off the flow of tobacco through the conduit 58.

The apparatus 10 also includes metered tobacco removing means, generally denoted as the numeral 64, located adjacent the vacuum means 30 for removing the metered amount of tobacco from the second conveyor means 16. The metered tobacco removing means 64 includes means for creating a positive air pressure above the bottom flight 36 of the second conveyor means 16 adjacent the vacuum means 30. As shown, positive air pressure creating means includes a first nozzle means 66 which extends transversely across the second conveyor 16 from one side wall 40 to the other side wall 42 immediately next to the perforated partition 44 outside the plenum chamber 38 and facing the top surface of the bottom flight 36 of the perforated endless belt 24 in order to eliminate residual vacuum across the top surface of the bottom flight 36. The nozzle 66 is in air flow communication with a source of pressurized air. For example, the first nozzle means 66 can be in air flow communication with the high pressure side of the vacuum pump 46 by a conduit 68. The apparatus 10 even further includes a high pressure air jet nozzle means 69 located at the bottom conveyor flight 36 downstream of the first nozzle 66 relative to the direction of movement of the bottom conveyor belt flight 36. The air jet nozzle means 69 extends transversely across the width of the bottom conveyor belt 36. The high pressure air jet nozzle means 69 is in air flow communication with a source of pressurized air, for example, the high pressure side of the vacuum pump 46. The air jet nozzle means 69 can be positioned to the exterior side of the bottom conveyor belt flight 36, that is at the exposed bottom surface of the bottom conveyor belt flight 36, or as shown it can be located in the interior side of the bottom conveyor belt flight 36 in the space between the top conveyor belt flight 34 and the bottom conveyor belt flight 36. In either position, the air jet nozzle means 69 is oriented to direct a stream of high velocity air against the bottom conveyor belt flight 36.

A third conveyor means 70 has its inlet end adjacent the bottom flight 36 of the second conveyor 16 proximate the nozzle 66 of the positive air pressure creating means for receiving the metered amount of tobacco from the second conveyor means 16 and conveying the removed metered amount of tobacco to another location. As shown, the third conveyor means 70 includes an endless belt conveyor apparatus having its upstream end located beneath the bottom flight 36 of the second conveyor 16. A funnel 72 is located between the bottom flight 36 of the second conveyor 16 and the upstream end of the third conveyor 70 to channel and guide the metered amount of tobacco to the third conveyor 70.

The apparatus 10 may further include winnower means 74 located between the downstream end of the first conveyor means 12 and the upstream end of the second conveyor means 16 for removing chaff, debris, dust, stems and other foreign material from the supply of tobacco 14 transferring from the first conveyor means 12 to the second conveyor means 16.

The winnower means 74 includes a rotatable winnower cylinder 76 adjacent to and extending across the downstream end of the first conveyor rotating in a counter direction to the rotation of the head pulley 20 of the first conveyor 12 so as to toss the supply of tobacco 14 leaving the first conveyor 12 in a generally upwardly direction. The winnowing means 74 further includes a winnowing collector hopper 78 spaced a distance from and above the downstream end of the first conveyor 12.

In operation, a supply of tobacco 14 is fed to the first conveyor 12 and is conveyed thereby to the upstream end of the second conveyor 16. As the tobacco supply leaves the first conveyor 12 at the downstream end thereof, the winnower cylinder 76 tosses it upwardly, the lighter chaff and debris falling into the winnowing collector hopper 78. The remaining tobacco falls onto the upstream end of the second conveyor 16 which conveys the tobacco toward the downstream end of the second conveyor 16. The vacuum means 30 then holds a preselected metered amount of the tobacco against the perforated belt 24 as the belt 24 moves around head pulley 26 making the transition from top to bottom. The excess tobacco not held against the conveyor belt 24 because it exceeded the preselected metered weight, falls into the hopper 52 and is returned through the return conduit 58 back to the first conveyor 12 to be recycled through the apparatus 10. As the perforated endless conveyor belt 24 of the second conveyor 16 returns to the feed or upstream end, the vacuum means 30 holds the metered amount of tobacco against the endless belt 24 as it passes the boundary of the plenum chamber 38 defined by the perforated partition 44 whereat the air stream issuing from the first air nozzle means 66 eliminates residual vacuum and also blows air through the perforated belt so that the metered amount of tobacco falls from the bottom flight 36 of the second conveyor 16 into the funnel 72. The high pressure air jet means 69 directs a high velocity stream of air against the bottom conveyor belt flight 36 to clear the perforations of the perforated belt 24 of residual tobacco, dust, and debris.

Figure 3:
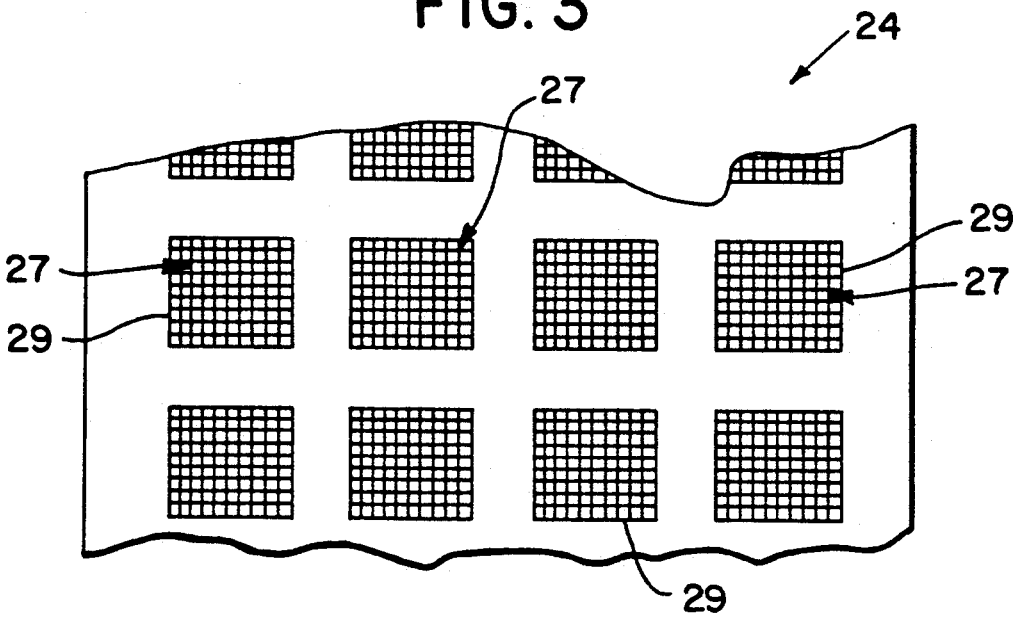

The second belt conveyor 16 can be operated either continuously or intermittently. For example, the belt 36 incorporating the spaced apart perforated areas 29 (FIG. 3) would be operated intermittently to supply tobacco pouches with measured amounts of tobacco.

The amount of metered tobacco can be selectively changed by varying the vacuum created in the plenum 38 by the vacuum creating device 32, or changing the conveying speed of the second conveyor 16, or selecting different conveyor belts 24 used on the second conveyor 16 having larger or smaller perforations 27, or varying the quantity of tobacco delivered to the second conveyor 16 from the first conveyor 14, or any combination of these variables.

The foregoing detailed description is given primarily for clearness of understanding and no unnecessary limitations should be understood therefrom for modifications will become obvious to those skilled in the art upon reading this disclosure and may be made without departing from the spirit of the invention or scope of the appended claims.

What is claimed is:

1. An apparatus for metering tobacco comprising first conveyor means for receiving a supply of tobacco; second conveyor means located downstream of the first conveyor means for receiving tobacco from the first conveyor means, said second conveyor means being an endless belt conveyor having a perforated belt; vacuum means associated with the second conveyor means for retaining a selected metered amount of the tobacco on said second conveyor means, said vacuum means comprising a device for creating a low pressure zone between the top and bottom belt flights of the second conveyor approximate the downstream end of the second conveyor;

excess tobacco receiving means located adjacent the second conveyor means for receiving the excess tobacco removed from the second conveyor means; means for returning the removed excess tobacco from the excess tobacco receiving means back to the first conveyor means; and, metered tobacco removing means located adjacent the vacuum means for removing the metered amount of tobacco from the second conveyor means, said metered tobacco removing means comprising means for creating a positive air pressure above the bottom flight of the second conveyor means adjacent the vacuum means.

2. The apparatus of claim 1, further comprising third conveyor means associated with the metered tobacco removing means for receiving the metered tobacco from the second conveyor means and conveying the removed metered amount of tobacco to another location.

3. The apparatus of claim 1, wherein the vacuum means is variable to selectively increase and decrease the vacuum created thereby.

4. The apparatus of claim 1, wherein the perforated belt of the second belt conveyor is constructed with perforations over the entire length and width of the belt.

5. The apparatus of claim 1, wherein the perforated belt of the second belt conveyor is constructed with spaced apart sections of perforations, the remaining areas of the belt being air impermeable.

6. The apparatus of claim 1, further comprising third conveyor means having an inlet end adjacent the bottom flight of the second conveyor means and proximate the positive air pressure creating means for receiving the metered amount of tobacco from the second conveyor means and conveying the removed metered amount of tobacco to another location.

7. The apparatus of claim 1 further comprising high pressure air nozzle means located downstream of the positive air pressure creating means for directing a high velocity air stream against the bottom flight of the second conveyor to remove residual tobacco, dust, and debris from the second conveyor means.

8. The apparatus of claim 1, further comprising high pressure air nozzle means located downstream of the vacuum means for directing a high velocity air stream against the second conveyor means to remove residual tobacco, dust, and debris from the second conveyor means.

9. The apparatus of claim 1, wherein the excess tobacco receiving means comprises a hopper located beneath the downstream end of the second conveyor means.

10. The apparatus of claim 9, wherein the means for returning removed excess tobacco back to the first conveyor means comprises:

a conduit having an inlet end in open communication with the hopper, and an outlet end over the first conveyor means; and, means for creating a conveying air flow through the conduit from the conduit inlet end to the conduit outlet end.

11. The apparatus of claim 1, further comprising winnower means located between the downstream end of the first conveyor means and upstream end of the second conveyor means for removing chaff and debris from the tobacco transferring from the first conveyor means to the second conveyor means.

* * * * *